United States Patent [19]

Brubaker

[11] Patent Number: 4,900,095

[45] Date of Patent: Feb. 13, 1990

[54] MINIATURE VEHICLE WHEEL MOUNTS

[76] Inventor: Thomas J. Brubaker, 5775 John R, Troy, Mich. 48098

[21] Appl. No.: 270,686

[22] Filed: Nov. 14, 1988

[51] Int. Cl.[4] ..... A63H 17/26

[52] U.S. Cl. ..... 301/63 PW; 301/9 DN; 301/10 R; 301/13 SM; 152/396

[58] Field of Search ..... 301/9 R, 9 DH, 9 CN, 301/9 DN, 10 R, 11 R, 11 CD, 13 R, 13 SM, 36 R, 63 DD, 63 DS, 63 PW; 152/376, 396, 399, 400, 401, 323; 446/431, 465

[56] References Cited

U.S. PATENT DOCUMENTS

| | | | |
|---|---|---|---|
| 2,416,862 | 3/1947 | Baker | 301/13 R |
| 2,868,260 | 1/1959 | Powers et al. | 301/63 DS X |
| 3,348,597 | 10/1967 | Goldberg et al. | 152/323 |
| 3,790,218 | 2/1974 | Johns | 301/36 R |
| 4,114,952 | 9/1978 | Kimmell | 301/63 PW X |
| 4,299,051 | 11/1980 | Pauley et al. | 301/9 DH X |
| 4,585,276 | 4/1986 | Tirhemer | 301/36 R |
| 4,639,046 | 1/1987 | Oleff et al. | 301/63 PW |

FOREIGN PATENT DOCUMENTS

| | | | |
|---|---|---|---|
| 876974 | 7/1949 | Fed. Rep. of Germany | 446/465 |
| 177795 | 8/1935 | Switzerland | 301/13 SM |

*Primary Examiner*—Russell D. Stormer
*Attorney, Agent, or Firm*—Ralph M. Burton

[57] ABSTRACT

A wheel assembly (10) designed to enable adaptation of various width wheels and various type tires on any one of a variety of miniature vehicles (12) includes an adapter hub (14) for mounting the wheel on an axle (54) of a specific miniature vehicle (12). Adapter hub (14) has standardized wheel mounting elements (18, 20). Each wheel includes a pair of rims (24, 24') arranged back-to-back with each rim having standardized spider portions (30) for mounting to the standardized wheel mounting elements. Circumferential peripheral surfaces 28 exhibit circumferential tire bead (36) receiving grooves between flanges (25, 26). For mounting foam type tires (38) the flanges (25, 26) are provided with spline receiving notches (42) for accepting splines (44) on a foam tire insert (46) adhesively secured within a foam tire (38).

10 Claims, 3 Drawing Sheets

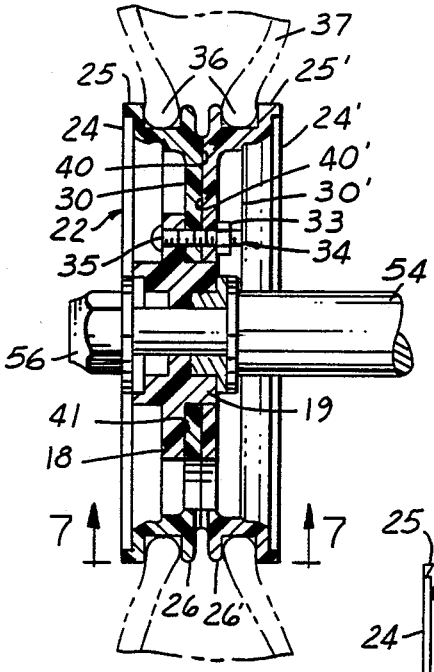
FIG.6
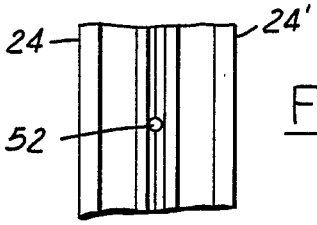
FIG.7
FIG.8
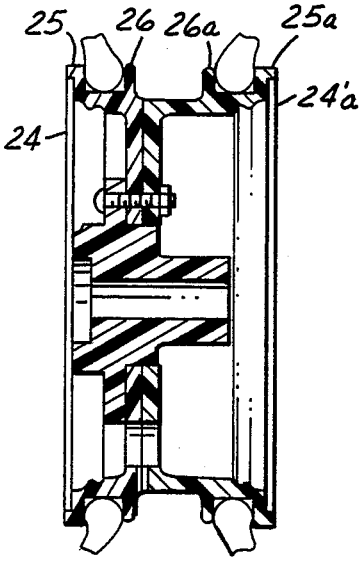
FIG.9
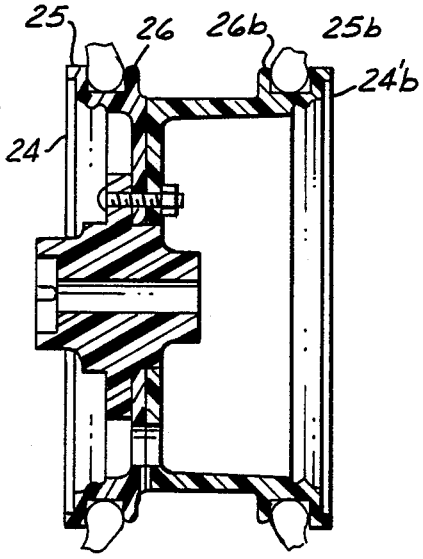
FIG.10
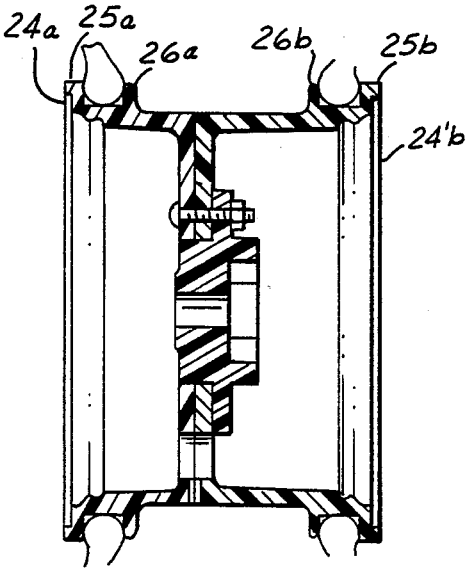
FIG.11
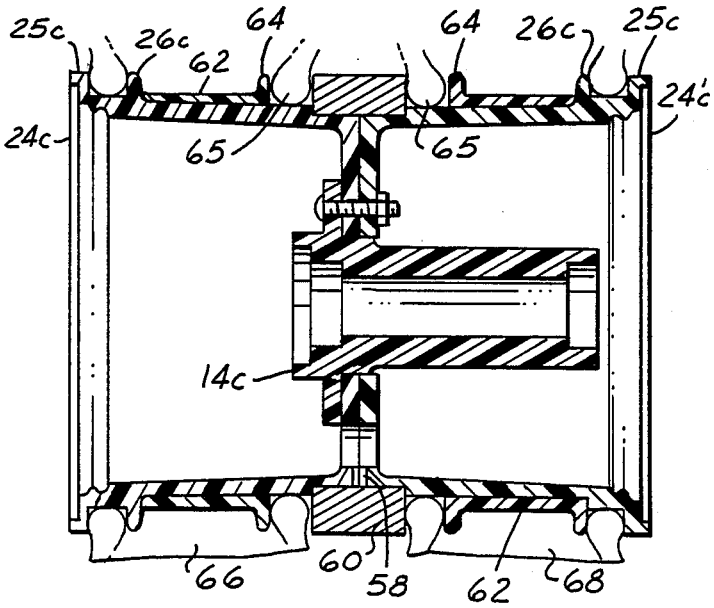

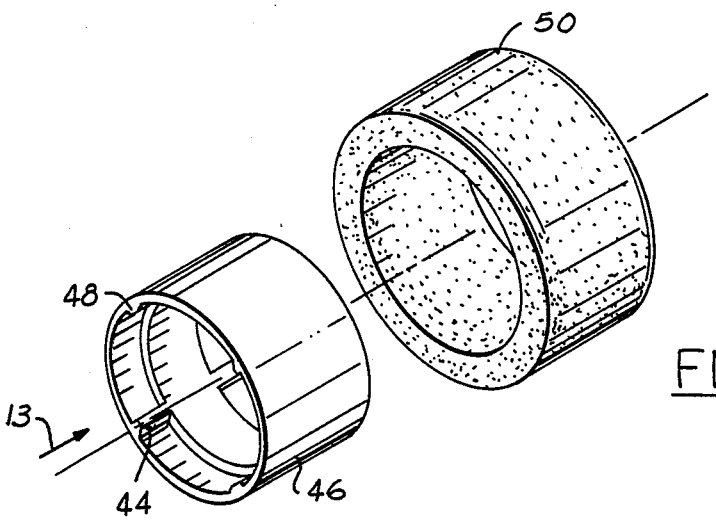
FIG. 12
FIG. 13
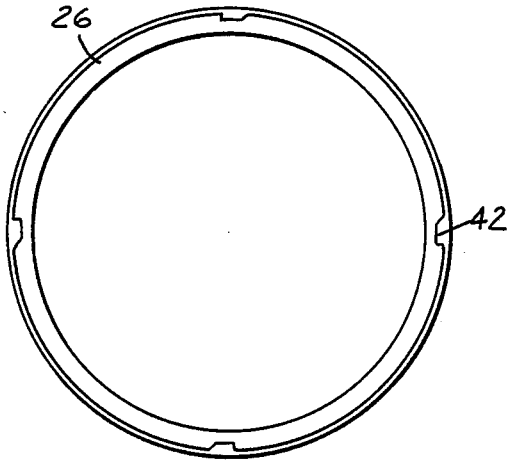
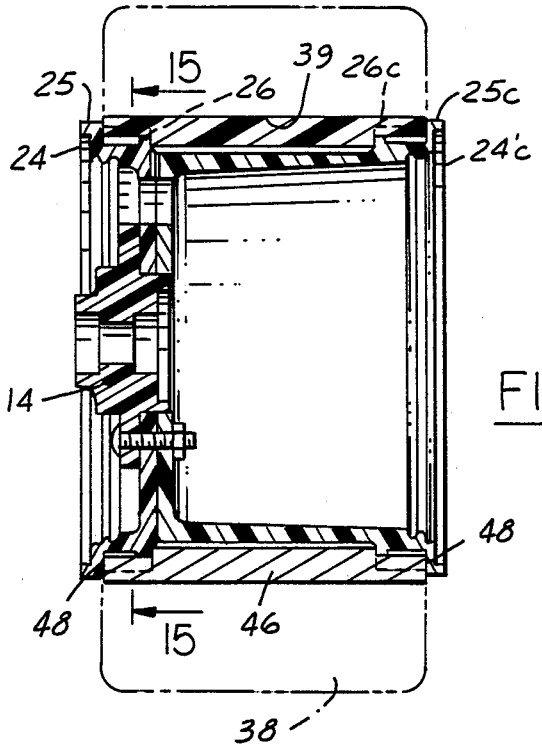
FIG. 14
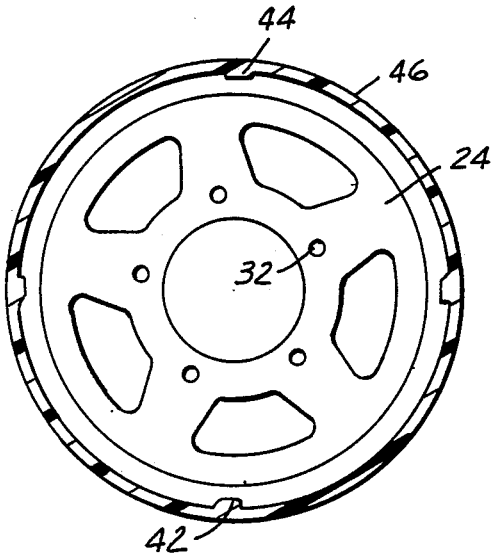
FIG. 15

MINIATURE VEHICLE WHEEL MOUNTS

TECHNICAL FIELD

This invention relates to a wheel assembly for miniature vehicles and more particularly to a standardized wheel for adaptation on any of a variety of miniature vehicles.

BACKGROUND ART

Miniature vehicle enthusiasts have been and are confronted with having to utilize specific wheel arrangements for each type of miniature vehicle they own. Also, these enthusiasts have to have specific wheel and tire combinations for each type of application for which the vehicle is being used. Typically, a wheel arrangement that fits on an axle assembly from one manufacturer of miniature vehicles does not fit on the axle assembly of another manufacturer. Conventional wheel assemblies cannot be used with foam or rubber tires and are not adaptable for receiving tires of different widths and types for use on different surfaces etc.

DISCLOSURE OF INVENTION

An object of the present invention is to provide a wheel assembly and wheel that can be adapted for use on any of a variety of miniature vehicles.

Another object of the invention is the provision of a wheel assembly for miniature vehicles tires.

A further object of the invention is the provision of a wheel assembly for miniature vehicles that is adaptable for use with different type tires of a variety of different widths.

In carrying out the above and other objects of the invention, a wheel assembly constructed in accordance with this invention comprises an adapter hub having mounting elements specifically made for mounting the adapter hub on an axle of a specific miniature vehicle. Such mounting elements will vary from mounting hub to mounting hub so as to adapt the hubs to specific miniature vehicles. Each adapter hub is otherwise of standardized design and has standardized wheel mounting elements for mounting a wheel on the hub. The wheel to be mounted comprises a pair of rims each having a central spider. The spider has standardized mounting elements for cooperation with the standardized elements on the hub. Fastener means mounts the rims in back-to-back, spider-to-spider arrangement on the adapter hub to form the wheel.

In an embodiment particularly suitable for foam tires, the wheel assembly includes a tire mounting insert or liner of a generally thin-wall tubular construction to the outside of which the foam tire is secured while the inside diameter surface of the mounting insert generally corresponds to the peripheral surface of the rims of the wheel for a slip fit thereon. Circumferentially arranged splines on the inside surface of the tire insert are received in corresponding spline grooves in the peripheral surface of the rim. The insert acts to align the rim elements, secure the tire on the wheel and transmit torque from the axle to the tire. The inserts may also be conveniently utilized during manufacture of the wheels for truing the foam tires.

In another embodiment each rim element includes a peripheral surface having a circumferential recess at one edge such that when the two rims are placed back-to-back for mounting on the adapter hub the circumferential recesses are aligned. The spider of each rim is located radially inwardly opposite these aligned recesses for attachment to the adapter hub. A ring bridges the aligned circumferential recesses for aligning the rims in a spider-to-spider arrangement for mounting the wheel on the adapter hub. This arrangement is particularly suitable for use with a dual tire assembly.

The above objects and other features and advantages of the present invention are readily apparent from the following description of the best mode for carrying out the invention when taken in conjunction with the accompanying drawings.

BRIEF DESCRIPTION OF THE DRAWINGS

FIG. 6 is a cross-sectional view of a wheel assembly comprising two rims arranged in back-to-back relation of the type shown in FIGS. 3–5, mounted on an adapter hub with a tire shown in phantom on the rims;

FIG. 7 is a partial view of a wheel assembly having an aligning aperture in the peripheral surface thereof;

FIGS. 8–11 inclusive illustrate how my wheel assembly design enables the provision of several different width wheels to accommodate various width tires, or in the case of FIG. 11 a dual tire;

FIG. 12 is an exploded perspective view of a foam tire and an insert therefore having circumferentially arranged ribs or splines for cooperation with a miniature vehicle wheel;

FIG. 13 is a side view of the tire insert looking in the direction of arrow 13 in FIG. 12;

FIG. 14 is a sectional view of a wheel assembly having a foam tire; and

FIG. 15 is a side view of a miniature vehicle wheel illustrating mounting of a foam tire insert on the wheel.

BEST MODE FOR CARRYING OUT THE INVENTION

Figure 1:
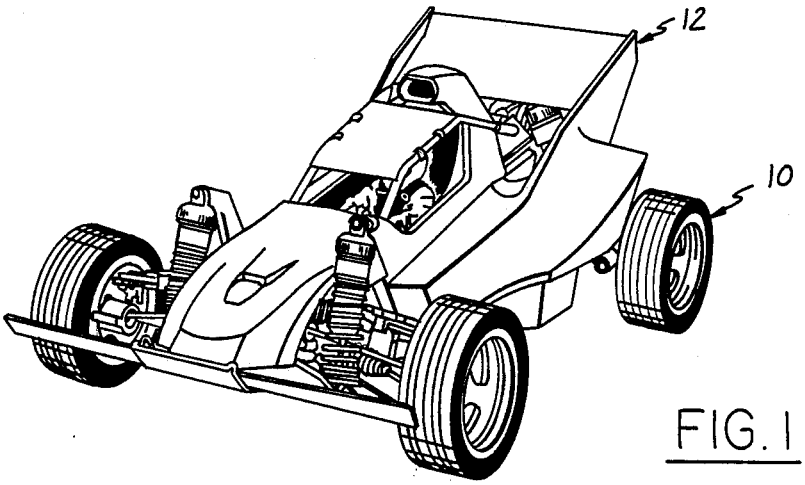
FIG. 1 is a perspective view of a miniature vehicle having wheel assemblies constructed in accordance with the present invention.

Referring to FIG. 1 of the drawings, a miniature wheel assembly indicated by reference numeral 10 is used on a miniature vehicle 12. As is hereinafter more fully described, the miniature wheel assembly 10 enables adaptation of various wheel arrangements on any of a variety of miniature vehicles and thereby avoids the necessity of having to maintain an inventory of different wheels that fit on the different axle assemblies of different miniature vehicles.

Figure 2:
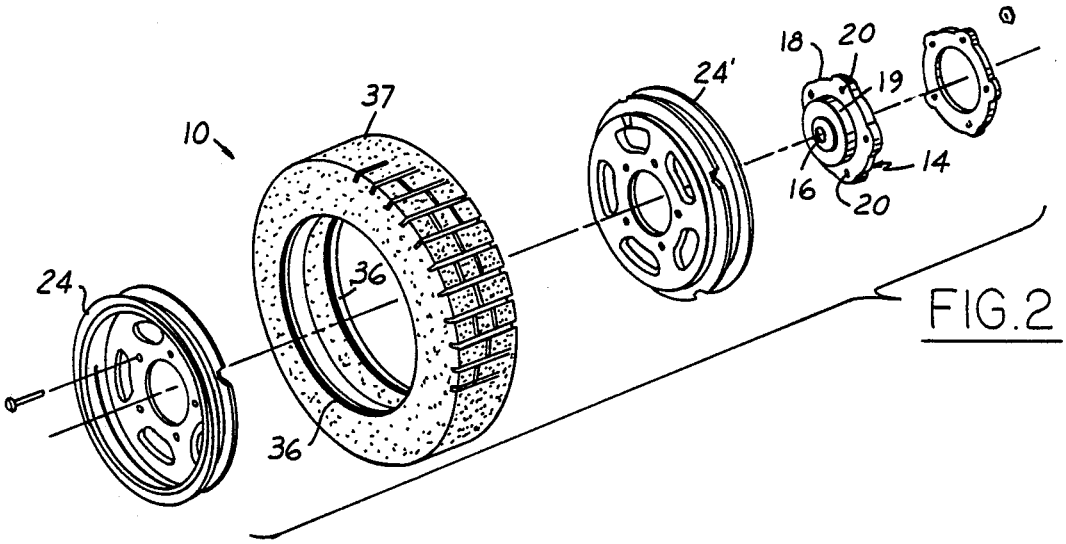
FIG. 2 is an exploded perspective view of the wheel assembly.

As shown in FIG. 2, the wheel assembly 10 comprises an adapter hub 14 having means for mounting the hub on an axle of a specific miniature vehicle 12. There is a specific adapter hub for each make or model of miniature vehicle and each has an axle mounting means specifically designed for mating with a specific vehicle axle. The adapter hub also has standardized wheel mounting elements 18 and 19. Element 18 comprises a radial flange having 5 equiangularly spaced apertures 20 for mounting a wheel 22 on the adapter. Element 19 comprises a central cylindrical boss concentric with the axis of the adapter hub for receiving thereon in a slip fit the central portion of the wheel spiders as shown in FIG. 6.

Each wheel 22 comprises two rims 24 and 24' arranged in back-to-back relation and having identical spider portions 30 and 30' respectively. Four different width rims are shown in the drawings. These may be assembled in various combinations to provide up to ten different width wheels for accommodating various width tires. The widest width wheel is intended as hereinafter explained, to accommodate dual tires, either rubber or foam. The four different width rims are designated with different alphabetic suffixes. Thus, rim 24 is the narrowest; rim 24A is the next widest; rim 24B is the next widest; rim 24C is the widest. The ten possible combinations are as follows:

| | |
|---|---|
| 24/24' | FIGS. 2 and 6 |
| 24/24'A | FIG. 8 |
| 24/24'B | FIG. 9 |
| 24/24'C | FIG. 14 |
| 24A/24'A | Not Illustrated |
| 24A/24'B | FIG. 10 |
| 24B/24'B | Not Illustrated |
| 24A/24'C | Not Illustrated |
| 24B/24'C | Not Illustrated |
| 24C/24'C | FIG. 11 |

Each rim includes a peripheral surface 28 having a tire bead receiving groove 29 defined by a pair of axially spaced flanges 25 and 26 which extends circumferentially around the rim and project radially outwardly therefrom and embrace the bead 36 of a rubber tire 37 mounted on the wheel 22 as shown best in FIGS. 8–11. Alphabetic reference numeral suffixes are used corresponding to the rim widths.

Figure 3:
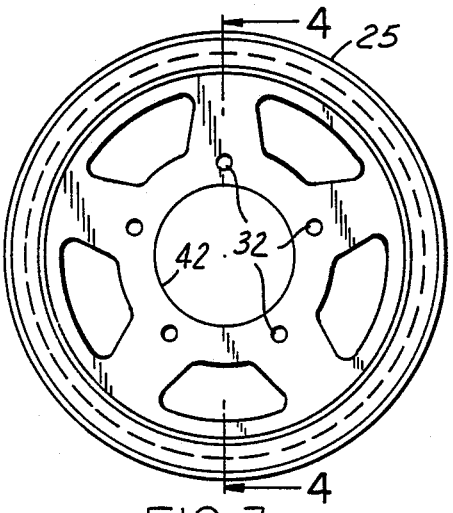
FIG. 3 is an outside side view of a rim for use in my wheel assembly.
Figure 4:
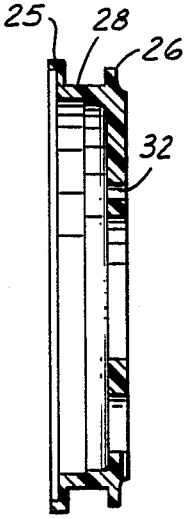
FIG. 4 is a cross-sectional view taken on line 4—4 of FIG. 3.
Figure 5:
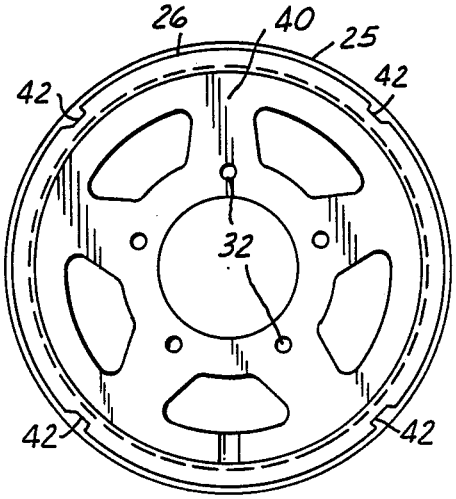
FIG. 5 is an inside side view (of the opposite side) of the rim shown in FIG. 3.

The spider 30 has apertures 32 therein as best shown in FIGS. 3–5 which correspond to the angular spacing and arrangement of apertures 20 and adapter hub 14. The spider 30 projects radially of the rim at an edge of peripheral surface 28. The spider 30 is disposed at varying distances axially from the tire bead receiving groove 29 from rim to rim such that by assembling selected rims of desired axial spacing of spider-to-groove, wheel assemblies of different widths are provided. A fastener 34 comprising, for example, a nut 33 and bolt 35 mount the rims 24 and 24' in back-to-back relation on the adapter 14 to form the wheel 22. A rubber tire 37 or foam tire 38 is mounted on the wheel 22 to form the assembly 10. It will be noted in FIG. 6 that the spiders 30 and 30' are in flush engagement of their inside surfaces 40 and overlie the inside surface 41 of the adapter hub flange 18 and are secured together and to such flange by the fasteners 34. Coaxial alignment of the spiders is assured by their slip fit on the central boss 19.

FIGS. 3 and 4 of the drawings illustrate one possible design for the construction of the spiders. The design is as matter of choice. Preferably the wheel assembly 10 construction is plastic which has been found to produce sufficient strength for miniature wheel application and economical to manufacture. The spider design may, of course, assume a wide variety of configurations. The only limitation being the provision of the standardized aperture 42 and the spacing of holes 32.

In order to mount foam tires on the wheels, the rims 24 are, as shown in FIGS. 5 and 12–15, provided in the inside flange 26 with a plurality of equiangularly spaced circumferentially arranged grooves 42 for receiving the ribs or splines 44 of a tire insert 46. The insert is a generally thin-walled tube having an inside diameter forming a slip fit on the peripheral surface of the rim 24. The tire 38 having a central mounting opening 39 is adhesively secured on the outside of the insert such that the latter in effect forms a relatively rigid liner or sleeve for the tire. The inter-fitting grooves 42 and splines 44 serve the important function of transmitting the axle torque to the foam tires. In addition, because the ends 48 of the ribs or splines, as best shown in FIG. 14, abut the inside surfaces of the outside flanges 25 and 25C, the ribs serve to lock the tire on the wheel against axial displacement of the insert 46. In FIG. 15, the engagement of the splines and grooves is clearly illustrated. An advantage of the foam tire insert 46 is that once it is adhesively secured within the foam tire, the insert may be used to mount the tire in a truing machine for diametrically sizing the tire and also trimming the tread surface to whatever shape is desired.

With continued reference to FIG. 5 and also with reference to FIG. 7, a small aperture 52 is provided in rims 24 and 24' which facilitates alignment of the two rims so that any pattern in the rims and the grooves 42 are correspondingly aligned when the rims are secured together.

In FIG. 6 the wheel is shown mounted on adapter hub 14 which is in turn mounted on an axle 54 of a specific miniature vehicle 12. A wheel nut 56 locks the adapter hub to the axle.

In FIGS. 8, 9, and 10, wheel assemblies are shown which have rims of different widths as mentioned above to provide different overall widths. The wheel assemblies are also illustrated with adapter hubs 14 having differently configured mounting elements 16 corresponding to different miniature vehicle axles. These adapter hubs allow the standardized rims 24, 24A, 24B, and 24C to be mounted on the adapters by the standardized wheel mounting elements 18, 19, and 20. At the same time the different adapters 14 enable mounting of the wheel assemblies 10 on different miniature vehicles.

In FIG. 11 a wheel for supporting dual tires is shown. In this embodiment the rims 24C and 24'C are of the greatest width and are provided at their inner edges with circumferentially aligned recesses 58 within which is nested an alignment and spacing ring 60. Also disposed on each rim is a spacer sleeve 62, one end of which abuts the flange 26C and the opposite edge of which defines a radially outwardly extending flange 64. The sleeve 62 in combination with the ring 60 provides an annular groove for receiving the bead 65 of dual tires 66 and 68. The opposite bead of each of these tires is received in the usual fashion between the flanges 25C and 26C. The adapter hub 14C is of course sized to accommodate the substantially greater width of the resulting wheel assembly.

The wheel shown in FIG. 11 for receiving the dual rubber tires 66 and 68 is also capable of receiving dual foam tires of the kind shown in FIG. 14. Each of the spacer sleeves 62 is provided in its flange 64 with grooves (not shown) arranged at the same angular spacing as the grooves 42 of the inner flanges 26. Thus, the foam tire insert 46 may be slipped over the periphery of each rim with the spacer sleeve 62 thereon and will be locked in place between the flanges 25C and the ring 60.

While the best mode for carrying out the invention has been described in detail, those familiar with the art to which this invention relates will recognize various designs and embodiments for practicing the invention as defined by the following claims without departing from the spirit of this invention.

What is claimed is:

1. A wheel assembly for miniature vehicles which enables adaptation of various wheel arrangement on any one of a variety of miniature vehicles, the wheel assembly comprising, in combination:

a series of adaptor hubs having mounting means specifically arranged for mounting each hub on the axle of a series of different specific miniatures vehicles;

each adaptor hub of said series also having identical standardized rim-mounting elements with apertures for mounting a rim thereon;

a series of rims having peripheral surfaces of varying axial width and each including a pair of radially extending circumferential shoulders for embracing the bead of a tire;

each rim having a spider with apertures therein corresponding to said standardized apertures in each of said adaptor hubs;

said spider projecting radially of said peripheral surface; and fasteners for mounting any pair of rims from said series in a spider-to-spider arrangement on any hub of said series to provide wheel assemblies having pairs of tire-embracing beads spaced apart axially varying distances to accommodate varying width tires.

2. The invention defined by claim 1 wherein a tire is mounted on the wheel assembly with a bead received between each pair of shoulders.

3. The invention defined by claim 1 wherein a foam tire is provided with axially extending ribs and said shoulders are provided with corresponding grooves for receiving said ribs when the foam tire is mounted on the wheel assembly.

4. The invention defined by claim 1 wherein at least some of said shoulders are provided with angularly spaced apart grooves and a foam tire is provided with a cylindrical liner having splines matching the grooves in said shoulders whereby the foam tire may be mounted on the wheel assembly with the splines and grooves interfitting.

5. The invention defined by claim 1 further including a ring member for overlying the peripheral surfaces of the rims to bridge the rims when in spider-to-spider relation.

6. The invention defined by claim 5 wherein a sleeve is provided on each rim having a flange cooperating with an edge of said ring to define a second tire bead receiving groove for each rim whereby dual tires may be mounted on each wheel assembly.

7. The invention defined by claim 1 wherein said peripheral surface includes axially extending grooves, a foam tire having an internal sleeve adhesively secured thereto, and said sleeve provided with radially inwardly extending ribs for cooperation with said grooves when the tire and liner are slidably received on the rim.

8. A wheel assembly for miniature vehicles adapted to receive either a rubber or foam type tire comprising, in combination:

a pair of rims having circumferential peripheral surfaces and radially disposed spiders configured to match in alignment when said rims are arranged in a spider-to-spider relation;

aperture means extending through said spiders;

fastener means to be extended through said aperture means for locking the spiders together;

an adapter hub having a radially-outwardly extending flange provided with apertures for alignment with the aperture means of said spiders to receive the fasteners means therethrough whereby the rims are locked on the adapter hub;

said adapter hub having a central coaxial spider receiving boss;

said spiders having central coaxial boss receiving openings sized for a slip fit on said boss;

each peripheral surfaces having circumferentially extending axially spaced flanges defining a bead receiving groove therebetween;

those flanges of said rims most closely disposed when the rims are fastened in back to back relation being provided with axially aligned rib receiving grooves for reception of ribs of a foam tire insert for locking a foam tire on the rims against relative rotation.

9. The invention defined by claim 8 wherein said bead receiving groove is disposed spaced axially of the rim from said spider.

10. The invention defined by claim 9 wherein said peripheral surface of each rim includes an alignment notch to be brought into registration when the rims are disposed in back-to-back relation to indicate proper alignment of spiders and rib receiving grooves.

* * * * *